US006986734B2

(12) United States Patent
Carr

(10) Patent No.: US 6,986,734 B2
(45) Date of Patent: Jan. 17, 2006

(54) CENTRIFUGAL SEPARATOR WITH SCRAPER OR PISTON FOR DISCHARGING SOLIDS

(75) Inventor: Robert B. Carr, Sharon, MA (US)

(73) Assignee: Wagner Development, Inc., (MC)

( * ) Notice: Subject to any disclaimer, the term of this patent is extended or adjusted under 35 U.S.C. 154(b) by 0 days.

(21) Appl. No.: 10/874,150

(22) Filed: Jun. 22, 2004

(65) Prior Publication Data

US 2005/0009681 A1 Jan. 13, 2005

Related U.S. Application Data

(63) Continuation of application No. 10/412,943, filed on Apr. 14, 2003, now Pat. No. 6,776,752.

(60) Provisional application No. 60/372,153, filed on Apr. 12, 2002.

(51) Int. Cl.
*B04B 9/12* (2006.01)
*B04B 11/08* (2006.01)

(52) U.S. Cl. ..... 494/46; 494/50; 494/55; 494/62; 494/83; 210/376

(58) Field of Classification Search ..... 494/38, 494/46, 50, 55, 56–59, 62, 65, 67, 82–84; 210/372–377; 384/154, 238, 235–236, 226–227, 384/498

See application file for complete search history.

(56) References Cited

U.S. PATENT DOCUMENTS

| | | | | |
|---|---|---|---|---|
| 1,909,188 A | | 5/1933 | Roberts | |
| 2,040,351 A | * | 5/1936 | Williams | 384/196 |
| 2,094,058 A | | 9/1937 | Bryson | |
| 3,306,681 A | | 2/1967 | Barringer | |
| 3,403,848 A | | 10/1968 | Windsor et al. | |
| 3,539,096 A | | 11/1970 | Lewis et al. | |
| 3,741,465 A | | 6/1973 | Lincoln | |

(Continued)

FOREIGN PATENT DOCUMENTS

CH 604 906 9/1978

OTHER PUBLICATIONS

Carr Powerfuge Brochure, Carr Separations, Inc., undated, p. 1-4.

(Continued)

*Primary Examiner*—Charles E. Cooley
(74) *Attorney, Agent, or Firm*—Weingarten, Schurgin, Gagnebin & Lebovici LLP

(57) ABSTRACT

A centrifugal separator provides for the discharge of solids by either an axial-motion scraper or a piston/extrusion assembly. The axial-motion scraper is used with hard-packed or friable solids, and includes an integral feed liquid accelerator and feed holes. The piston/extrusion assembly is used with pasty solids, and includes a piston extending into a separator bowl and having openings permitting fluid communication across the piston. After high-speed separation is complete, a centrate valve closes one end of the bowl, and the piston is moved axially in the bowl by an actuator. Accumulated solids are scraped from the sides of the bowl and extruded out of the piston openings for discharge from the bowl. A bowl suspension employs a spherical mounting structure and a short, stiff spindle. A spherical portion of a bearing housing is mounted in a spherical mounting region at one end of the separator, with a cylindrical portion of the bearing housing extending along the rotational axis. A bearing and the spindle of the separator bowl are mounted within the cylindrical portion of the bearing housing. The suspension is retained by a stiff resilient ring and retaining member secured to the separator in compressive contact with the spherical portion of the bearing housing.

38 Claims, 16 Drawing Sheets

U.S. PATENT DOCUMENTS

| | | | | | |
|---|---|---|---|---|---|
| 3,770,191 | A | | 11/1973 | Blum | |
| 3,972,514 | A | * | 8/1976 | Voitsekhovsky et al. | 494/50 |
| 4,155,503 | A | | 5/1979 | Sears | |
| 4,416,655 | A | | 11/1983 | Bennett | |
| 4,493,768 | A | | 1/1985 | Paschedag et al. | |
| 4,493,769 | A | | 1/1985 | Paschedag et al. | |
| 4,513,566 | A | * | 4/1985 | Rajsigl et al. | 384/227 |
| 4,687,463 | A | * | 8/1987 | Simonnet | 494/83 |
| 4,692,247 | A | | 9/1987 | Orlans | |
| 4,875,334 | A | * | 10/1989 | Rajsigl et al. | 384/227 |
| 5,250,180 | A | | 10/1993 | Chang | |
| 5,328,441 | A | | 7/1994 | Carr | |
| 5,356,367 | A | | 10/1994 | Carr | |
| 5,364,335 | A | * | 11/1994 | Franzen et al. | 494/15 |
| 5,425,698 | A | | 6/1995 | Carr | |
| 5,454,777 | A | | 10/1995 | Ziems et al. | |
| 5,674,174 | A | | 10/1997 | Carr | |
| 5,733,238 | A | | 3/1998 | Carr | |
| 5,743,840 | A | | 4/1998 | Carr | |
| 5,879,279 | A | | 3/1999 | Berger et al. | |
| 6,126,587 | A | | 10/2000 | Berger et al. | |
| 6,149,573 | A | | 11/2000 | Berger et al. | |
| 6,224,532 | B1 | | 5/2001 | Beattey | |
| 6,461,286 | B1 | | 10/2002 | Beattey | |
| 6,478,724 | B1 | | 11/2002 | Beattey | |
| 2002/0016243 | A1 | | 2/2002 | Carr | |

OTHER PUBLICATIONS

Alfa-Laval CHPX Centrifuge Brochure, Alfa Laval, Inc., undated, p. 1.

Shanghai Centrifuge Institute, SCI Tube Bowl Centrifuge, Shanghai, China, undated, p. 1-2.

* cited by examiner

CENTRIFUGAL SEPARATOR WITH SCRAPER OR PISTON FOR DISCHARGING SOLIDS

CROSS REFERENCE TO RELATED APPLICATIONS

This application is a continuation of U.S. application Ser. No. 10/412,943, now U.S. Pat. No. 6,776,752 filed on Apr. 14, 2003 entitled, AUTOMATIC TUBE BOWL CENTRIFUGE FOR CENTRIFUGAL SEPARATION OF LIQUIDS AND SOLIDS WITH SOLIDS DISCHARGE USING A SCRAPER, and also claims priority under 35 U.S.C. § 119(e) of U.S. Provisional Patent Application No. 60/372,153 filed Apr. 12, 2002, the whole of which are hereby incorporated by reference herein.

STATEMENT REGARDING FEDERALLY SPONSORED RESEARCH OR DEVELOPMENT

Not Applicable.

BACKGROUND OF THE INVENTION

The present invention generally relates to centrifuges and in particular to a centrifuge enabling automatic discharge of solids that accumulate during separation.

Many different types of centrifugal separators are known for separating heterogeneous mixtures into components based on specific gravity. A heterogeneous mixture, which may also be referred to as feed material or feed liquid, is injected into a rotating bowl of the separator. The bowl rotates at high speeds and forces particles of the mixture, having a higher specific gravity, to separate from the liquid by sedimentation. As a result, a dense solids cake compresses tightly against the surface of the bowl, and the clarified liquid, or "centrate", forms radially inward from the solids cake. The bowl may rotate at speeds sufficient to produce forces 20,000 times greater than gravity to separate the solids from the centrate.

The solids accumulate along the wall of the bowl, and the centrate is drained off. Once it is determined that a desired amount of the solids has been accumulated, the separator is placed in a discharge mode. In one such discharge mode, a scraper blade extending the length of the rotating bowl is placed in a scraping position against the separator wall and the bowl is rotated at a low scraping speed. Then, a radial-motion scraper scrapes the solids from the sides of the bowl, and they fall toward a solids collecting outlet. However, such a radial-motion scraper does not effectively remove wet or sticky solids which may have a consistency like that of peanut butter. In such instances, the sticky solids remain stuck on the scraper blades or fall from the wall and then reattach to the blades before reaching the collecting outlet. As a result, the solids recovery yield is reduced and the remaining solids undesirably contaminate the separator.

An additional important consideration in the design of centrifugal separators is to minimize vibration and other ill effects of operation at high rotational speeds. The separator bowl and its mounting structure form a mechanical unit having inherent resonant or "critical" speeds which are preferably avoided during operation. An additional consideration is potential for axial movement of the separator bowl, for example in the presence of imbalance or the motion of liquid axial waves in the bowl, which can result in unstable operation.

SUMMARY OF THE INVENTION

In accordance with the present invention, a centrifugal separator is disclosed that includes features addressing the shortcomings of existing centrifugal separators, especially shortcomings associated with solids recovery and mechanical instability.

In one aspect, the disclosed centrifugal separator provides for automatic discharge of solids by means of either an axial-motion scraper or a piston/extrusion assembly with exchangeable parts, having variable speed operation for greater versatility. The axial-motion scraper is used with hard-packed or friable solids, and includes an integral feed liquid accelerator and feed holes. The scraper blades flex outwardly under high centrifugal force to lock the scraper in place against the bowl. This provides a rigid or fixed end condition for the lower end of the scraper shaft to allow for high critical speed of the shaft. The scraper provides less surface area for solids to stick to, and can be used in conjunction with relatively long separator bowls.

The piston/extrusion assembly is used for pasty, sticky solids that can be extruded. A centrate valve at the top of the bowl is used to enable the centrate (separated liquid) to be discharged during a feed mode of operation, and then to close off the top of the bowl for a solids discharge mode of operation. The assembly further includes a piston that sits at the bottom of the bowl during the feed mode of operation. The piston has an integral feed accelerator and feed holes through which the feed liquid passes. These holes also provide exit paths for the solids during the extrusion that takes place in the solids discharge mode of operation. The piston/extrusion assembly can be used with sticky solids that other existing centrifuges cannot discharge efficiently, and provides for nearly complete removal of the solids, which is desirable for example when the solids contain valuable materials.

In another aspect, the disclosed centrifugal separator includes a separator bowl suspension that employs a short, stiff spindle and a spherically mounted bearing housing. Conceptually, the arrangement is analogous to a vertical rotating beam with a simply supported upper end. This arrangement has a very high critical speed as compared to existing centrifuges. It is possible to achieve a critical speed greater than the highest operating speed, so that the critical speed is not encountered during operation. The spherically mounted bearing housing restrains axial motion of the separator bowl and provides for stable operation at higher speeds than prior mounting arrangements. In one embodiment, the bearing housing comprises a semi-spherical portion having an upper semi-hemispherical portion and a lower semi-hemispherical portion, and a cylindrical portion.

In yet another aspect, the disclosed centrifugal separator employs a half-ball-shaped solids discharge valve at the bottom of the case. The discharge valve incorporates respective passages for the feed liquid and for residual liquid being drained from the bowl. The valve rotates between a closed position in which the bottom of the case is closed except for the openings to and from the feed liquid and residual liquid passages, and an open position in which solids being discharged from the separator bowl are able to fall out of the bottom of the case. This arrangement is generally more compact than prior art arrangements for discharge valves, and can be used in sanitary and/or clean-in-place applications.

Other aspects, features, and advantages of the present invention will be apparent from the Detailed Description Of The Invention that follows.

DESCRIPTION OF THE DRAWINGS

The invention will be more fully understood by reference to the following Detailed Description Of The Invention in conjunction with the Drawings, of which.

DETAILED DESCRIPTION OF THE INVENTION

Figure 1:
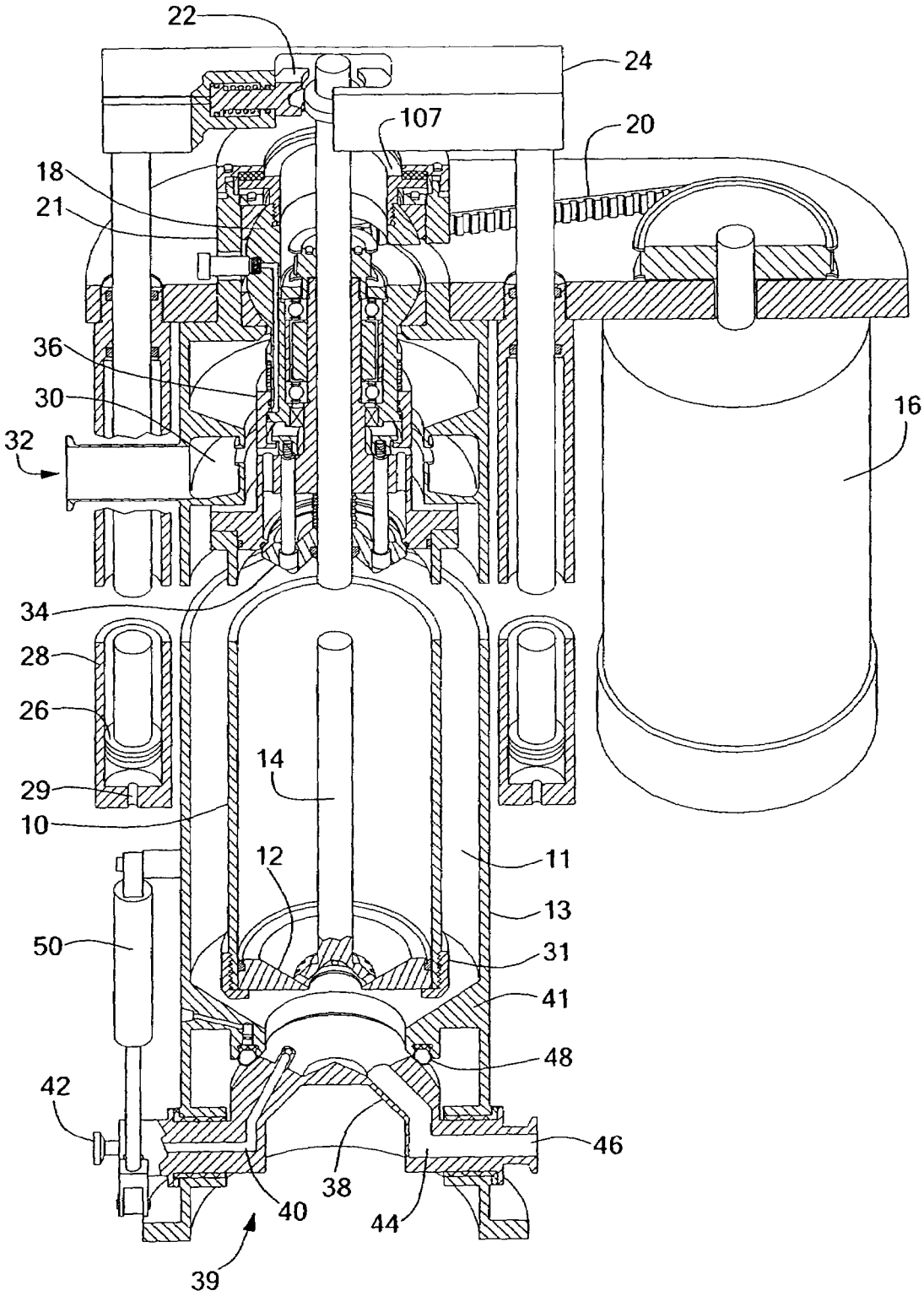
FIG. 1 is a section view of a centrifuge having a first construction in accordance with the present invention.

FIG. 1 shows a centrifugal separator in vertical section, with a middle portion removed so as to illustrate a horizontal section as well. The centrifugal separator includes a cylindrical separator bowl 10 mounted in a central region 11 of a separator housing 13. The separator bowl 10 is preferably a tubular type bowl having a relatively small diameter D and a length L such that the ratio of L/D is approximately 5/1 or greater. Mounted within the separator bowl 10 is a piston assembly consisting of a piston head 12 connected to a piston shaft 14.

A variable speed drive motor 16 is connected to a drive pulley of a spherically mounted bearing and spindle assembly 18. The connection is made by a drive belt 20 at a collar-like extension 21 of the upper end of the separator housing 13. The drive motor 16 is controllably operated to rotate the separator bowl 10 at desired speeds for separating the feed liquid. A piston shaft clutch 22 is mounted in a crosshead 24 of a piston actuator which includes two piston actuator plungers 26 mounted in respective piston actuator cylinders 28. Each piston actuator plunger 26 is operatively connected to the piston shaft 14 via the crosshead 24 and the piston shaft clutch 22 for raising and lowering the piston assembly within the separator bowl 10 in response to compressed air or hydraulic fluid introduced at piston actuator ports 29. In a discharge mode of operation, the piston shaft clutch 22 is engaged for holding the piston shaft 14 while the piston actuator is raised so that the edges of the piston head 12 scrape solids from the walls of the separator bowl 10. In other operating modes, the piston shaft clutch 22 is disengaged so that the piston assembly simply rotates with the separator bowl 10 and does not move axially. In these operating modes, a lock ring 31 prevents the piston assembly from falling out of the bottom opening of the separator bowl 10.

Also shown in FIG. 1 are a centrate case 30, centrate outlet port 32, centrate valve 34 and centrate valve actuator 36, all of which are involved in removing the centrate, or clarified liquid, from the centrifugal separator during operation, as described in more detail below. A solids valve 38 is mounted in a lower end region 39 of the separator housing 13, below an inward-facing flange 41. The solids valve 38 incorporates both a feed liquid passage 40 in communication with a feed liquid port 42, as well as a residual liquid drain passage 44 in communication with a residual liquid drain port 46. A solids valve seal 48 is disposed on a lower surface of the flange 41. Additional structural and functional details of the solids valve 38 are described below.

Figure 2:
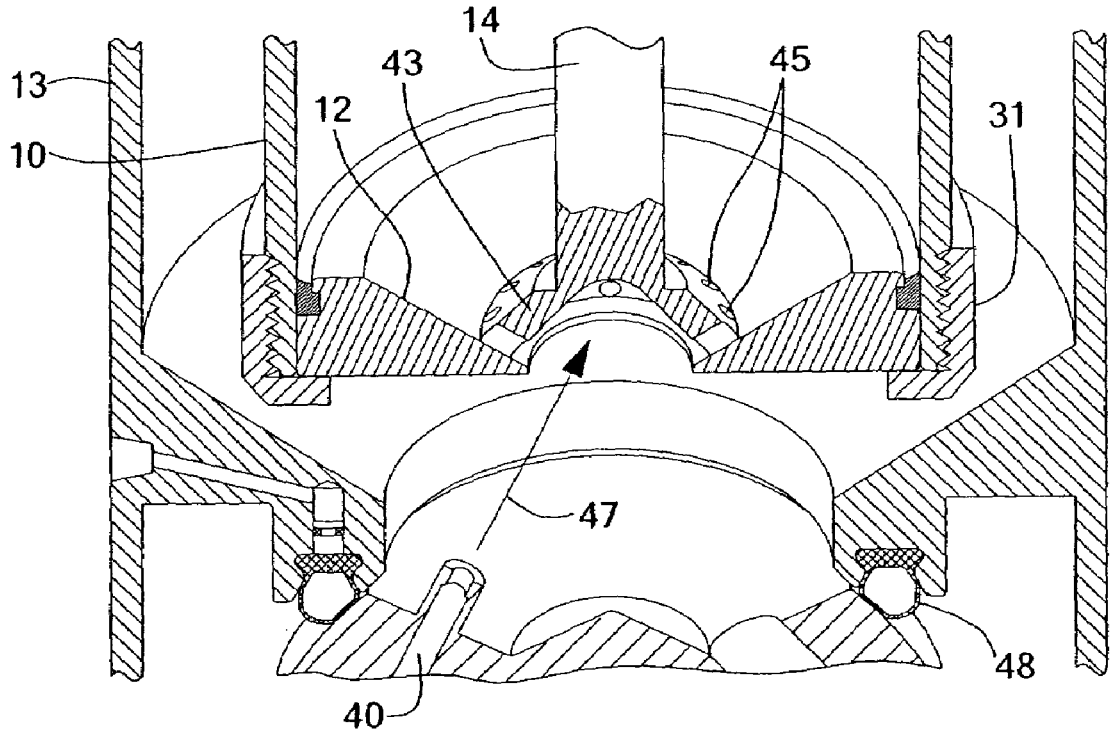
FIG. 2 is a detailed section view of a lower portion of a separator bowl in the centrifuge of FIG. 1.

FIG. 2 shows the area of the piston head 12 in detail. The central area 43 of the piston head 12 has an inverted cone-shaped cross section, with openings 45 arranged around the perimeter. In a feed mode of operation, as described below, feed liquid from the feed liquid passage 40 enters the cavity beneath the central area 43, as indicated at 47, and is directed out of the openings 45 toward the inner surface of the separator bowl 10. Due to rotation of the piston head 22 in this operating mode, the openings 45 serve to accelerate the feed liquid and distribute it around the bottom of the separator bowl 10.

Figure 3:
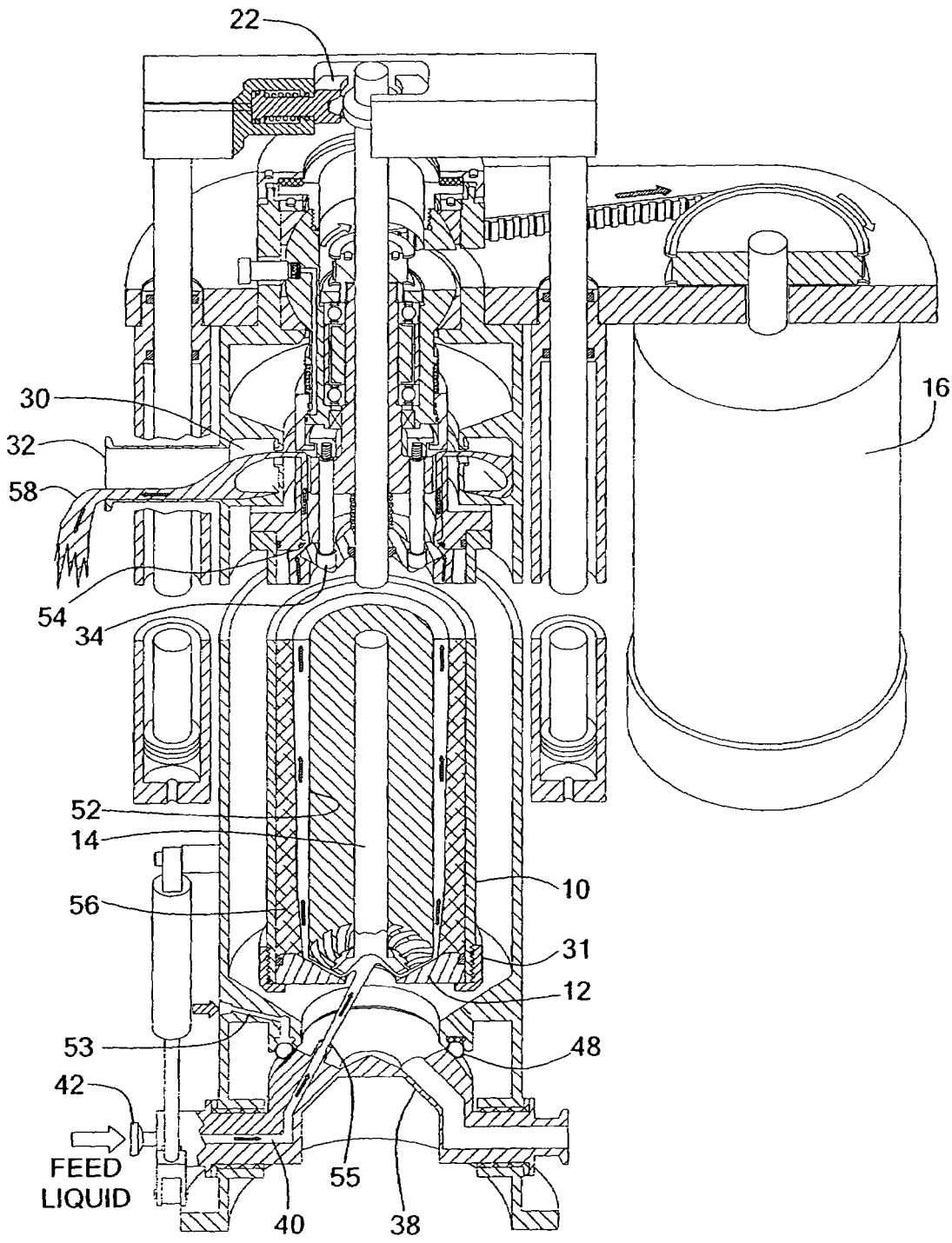
FIG. 3 is a section view of the centrifuge of FIG. 1 illustrating operation in feed mode.

A feed mode of operation of the centrifugal separator is described with reference to FIG. 3. The piston shaft clutch 22 is disengaged so that the piston shaft 14 is free to rotate at high speed with the separator bowl 10 under the influence of the drive motor 16. The solids valve 38 is in a closed position in which its outer upper surface rests against the solids valve seal 48. The solids valve seal 48 is pneumatically or hydraulically inflatable by a solids valve actuator 50 via an inflating passage 53. In the feed mode, the seal 48 is maintained in an inflated state.

The feed liquid is introduced through the feed liquid port 42. The feed liquid flows from the feed liquid port 42 into the feed liquid passage 40, and upon reaching the end of the feed liquid passage 40 continues in a stream 55 toward the bottom of the piston head 12. As described above, the piston head 12 includes structure that operates to accelerate the feed liquid and direct it toward the inner wall of the bowl 10 as it rotates. Due to the centrifugal force, the liquid flows up the inner surface of the separator bowl 10 forming a pool surface 52. As shown, the centrate valve 34 is open, so that any overflow liquid decants over a weir 54 as clarified liquid (centrate) at the top of the separator bowl 10. The centrate then flows into the centrate case 30 and out of the centrate outlet port 32 as shown at 58. As the liquid flows through the separator bowl 10, it is clarified of entrained solid particles by the high centrifugal force acting upon the liquid. The solids are forced to settle on the inside wall of the separator bowl 10 and collect as a compressed solids cake 56 as a result of the centrifugal force.

Figure 4:
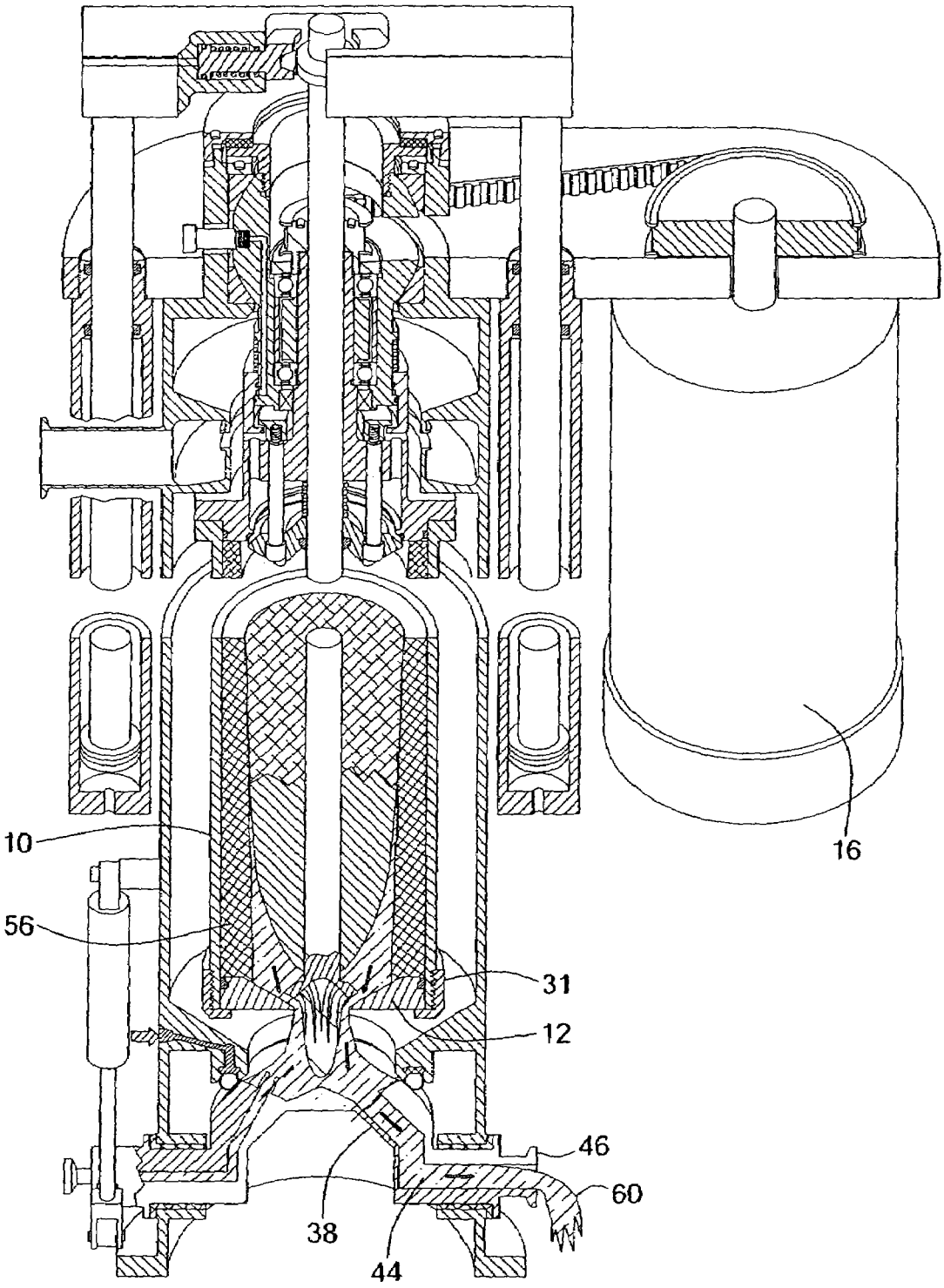
FIG. 4 is a section view of the centrifuge of FIG. 1 illustrating operation in residual liquid drain mode.

When the separator bowl 10 has been determined to be sufficiently full of solids, for example by sensing the turbidity of the centrate, the centrifugal separator is placed in a bowl drain mode which is depicted in FIG. 4. The feed liquid is shut off and the driver motor 16 electronically brakes the separator bowl 10 to a full stop. The residual liquid in the separator bowl 10 drains down through the openings in the piston head 12 onto a shaped upper surface of the solids valve 38, which channels the residual liquid into the liquid drain passage 44. The residual liquid then exits via the liquid drain port 46 as shown at 60. The separator bowl 10 may be rotated again to further separate liquid from the solids, depending on the application.

Figure 5:
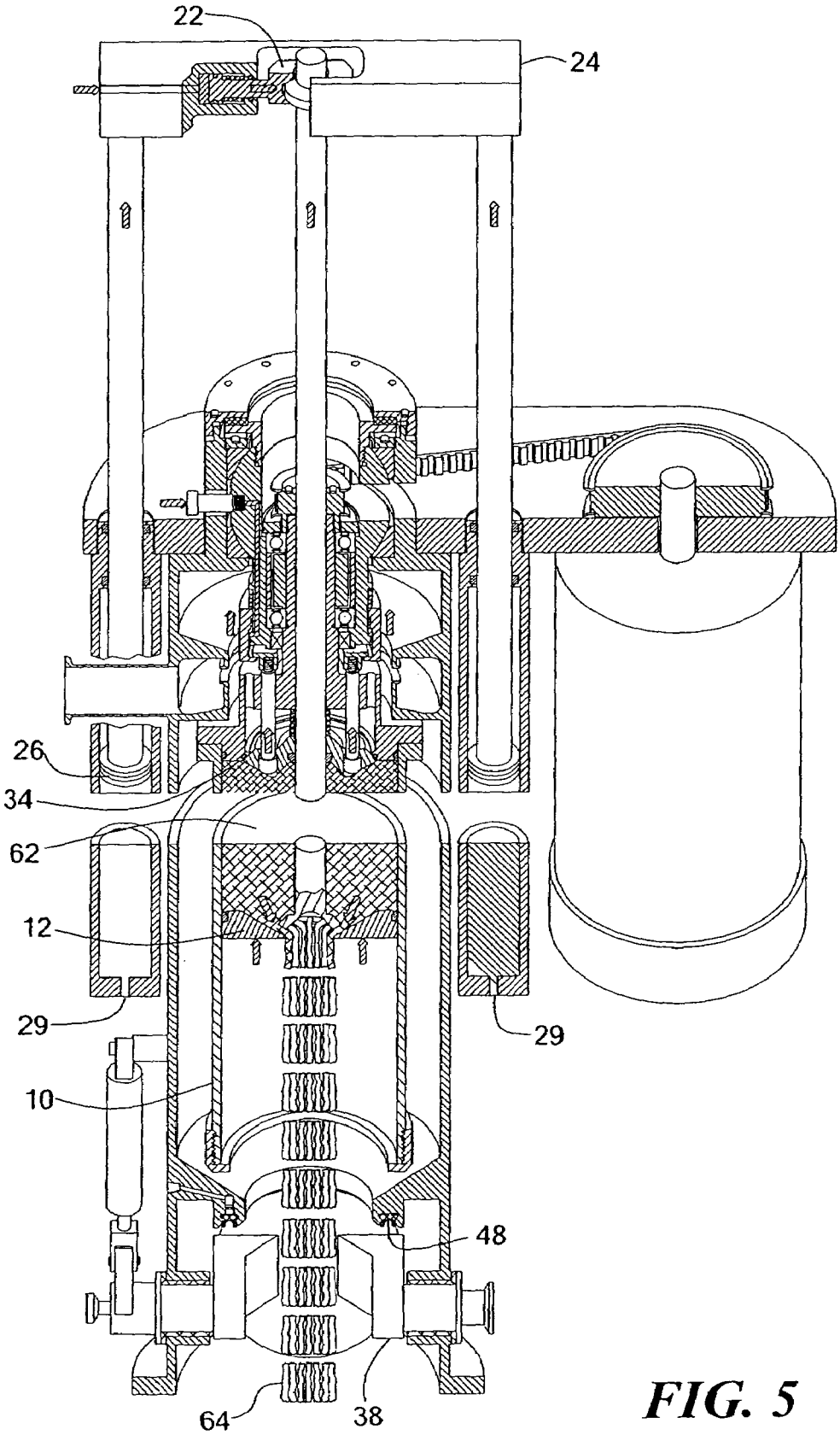
FIG. 5 is a section view of the centrifuge of FIG. 1 illustrating operation in solids discharge mode.
Figure 6:
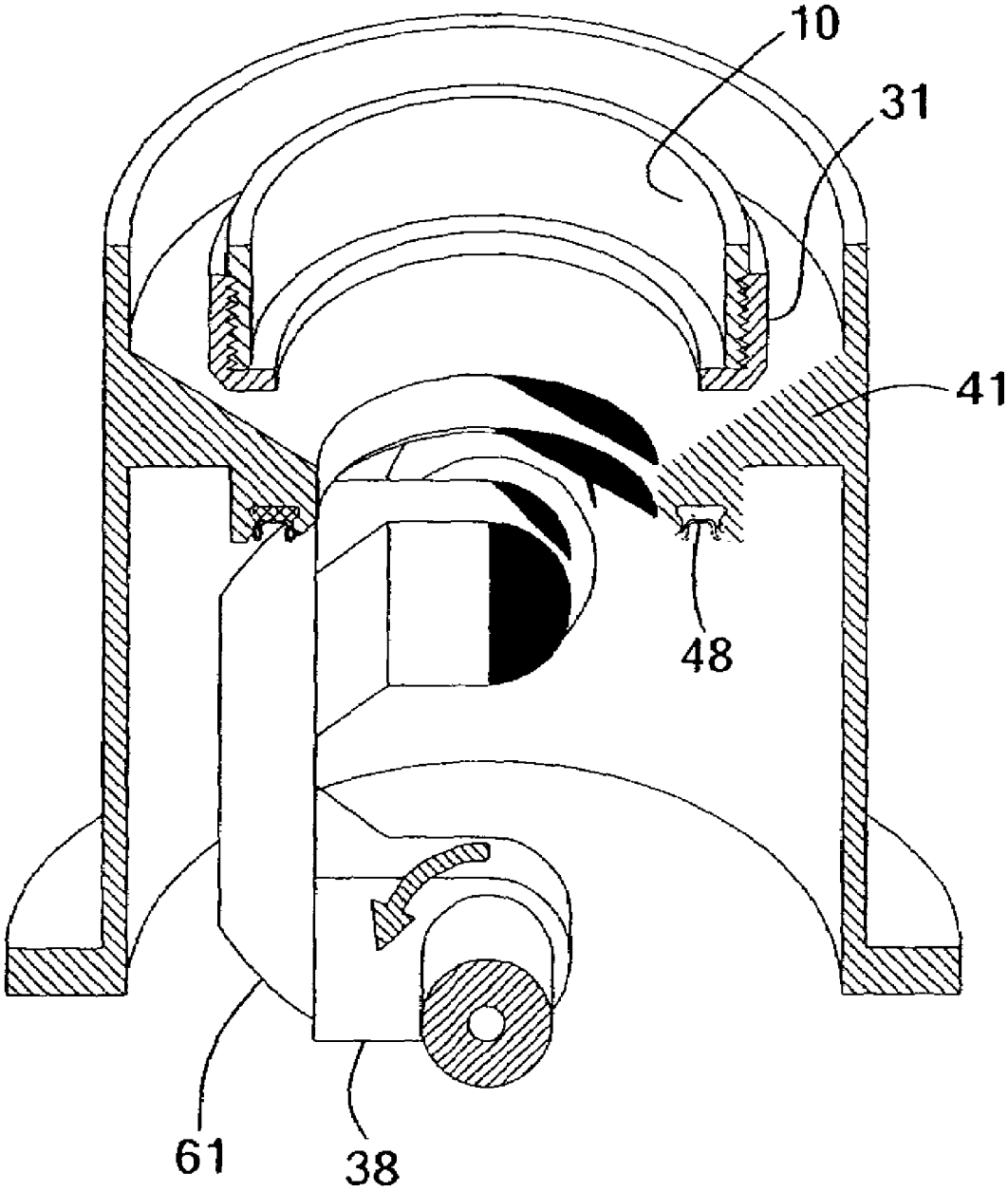
FIG. 6 is a detailed section view of a lower part of the centrifuge of FIG. 5, as viewed from a point to the left in FIG. 5.

When the separator bowl 10 has been completely drained of residual liquid, the centrifugal separator enters a "piston" mode in which the accumulated solids are forced out of the separator bowl 10. The piston mode is illustrated in FIGS. 5 and 6. The solids valve seal 48 is deflated and the upper offset portion 61 of the solids valve 38 is rotated away from the opening defined by the inner edge of the flange 41. The piston shaft clutch 22 engages the piston shaft 14, and the centrate valve 34 is closed by action of the centrate valve actuator 36. Then, by action of the piston actuator including plungers 26 and cylinders 28, the crosshead 24 is slowly raised, and with it the piston shaft 14 and piston head 12. As the piston head 12 is drawn upward, the accumulated solids are scraped away from the inner surface of the separator bowl 10 and eventually fill the compressed space 62 above the piston head 12. Further raising of the piston head 12 results in pressure on the enclosed solids, forcing them to be extruded downward through the openings in the piston head 12. The extruded solids fall downward through the open bottom of the separator bowl 10 and past the open solids valve 38, as indicated at 64. This extruding action continues until the piston head 12 has been raised to its maximum height, at which point substantially all of the accumulated solids have been removed. At this point, the components including piston head 12, centrate valve 34 and solids valve 38 are returned to their respective positions as shown in FIG. 1 for the next feed/drain/piston cycle. At this point, a cleaning operation may also be performed in preparation for the next operational cycle.

Figure 7:
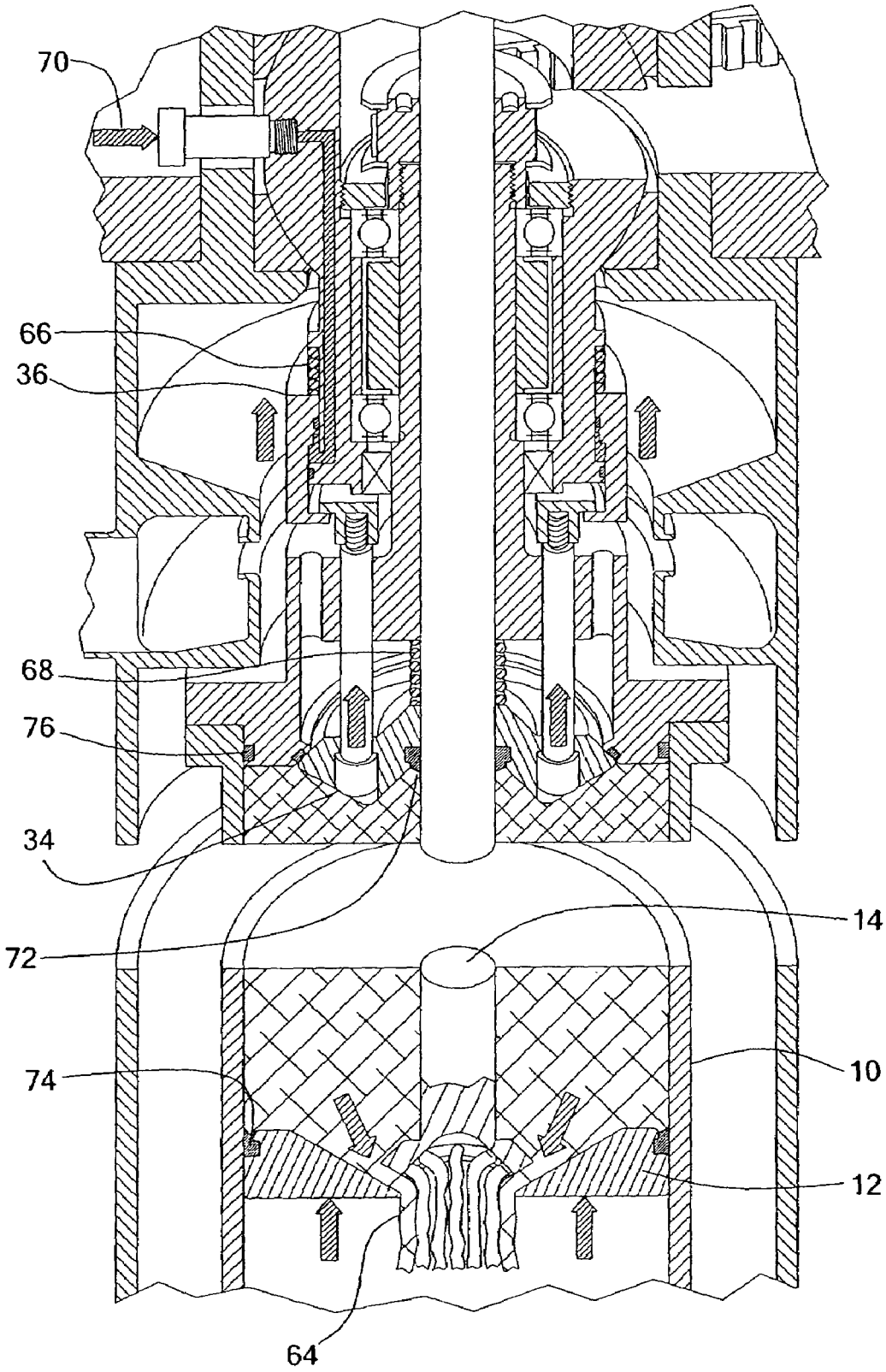
FIG. 7 is a detailed section view of an upper bowl portion of the centrifuge of FIG. 5.

FIG. 7 shows the area of the centrate valve 34 during the piston mode of operation in greater detail. The centrate valve 34 is normally held open by return springs 66 and 68. Under the action of compressed air or hydraulic fluid 70, the centrate valve actuator 36 is raised, bringing the centrate valve 34 to a closed position. As the piston head 12 is raised by action of the piston actuator, the soft solids are extruded through openings 70 of the piston head, as indicated at 64. As shown, several seals including piston shaft seal 72, piston head seal 74, and centrate valve seal 76 provide for fluid-tight sealing of the upper part of the bowl 10 in the piston mode, such that the solids are forced only through the piston openings.

Figure 8:
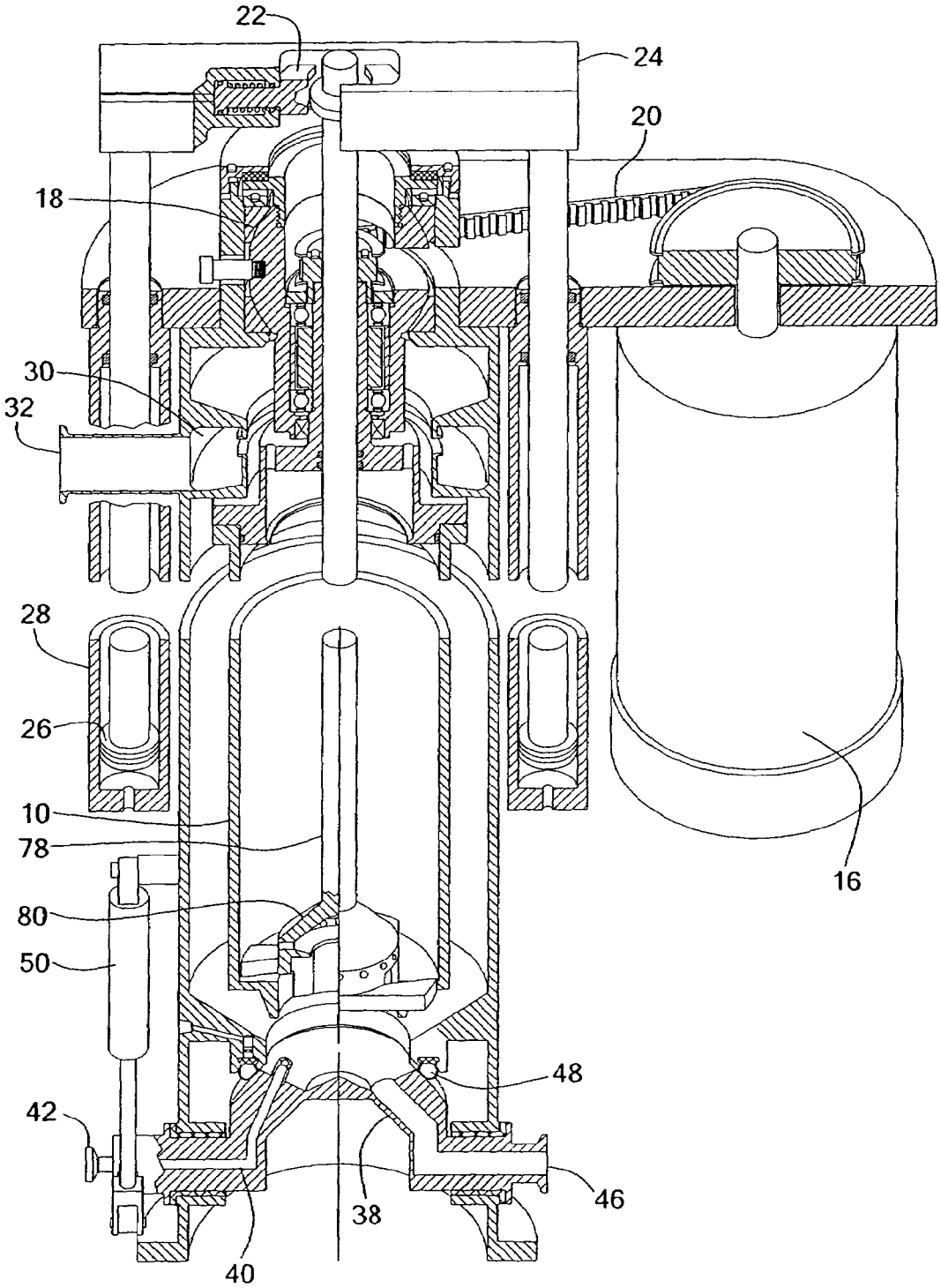
FIG. 8 is a section view of a centrifuge having a second construction in accordance with the present invention.

FIG. 8 shows a centrifugal separator similar in many respects to the centrifugal separator of FIGS. 1–7. The primary difference is the use of a scraper having a scraper shaft 78 and scraper head 80 instead of a piston. Also, the centrifugal separator of FIG. 9 does not include the centrate valve 34 and associated apparatus found in the centrifugal separator of FIGS. 1–7. The centrifugal separator of FIG. 8 employs a helical scraping action on the inner surface of the bowl 10 rather than an extruding action, and can generally be used with accumulated solids that are relatively dense and rigid.

Figure 9:
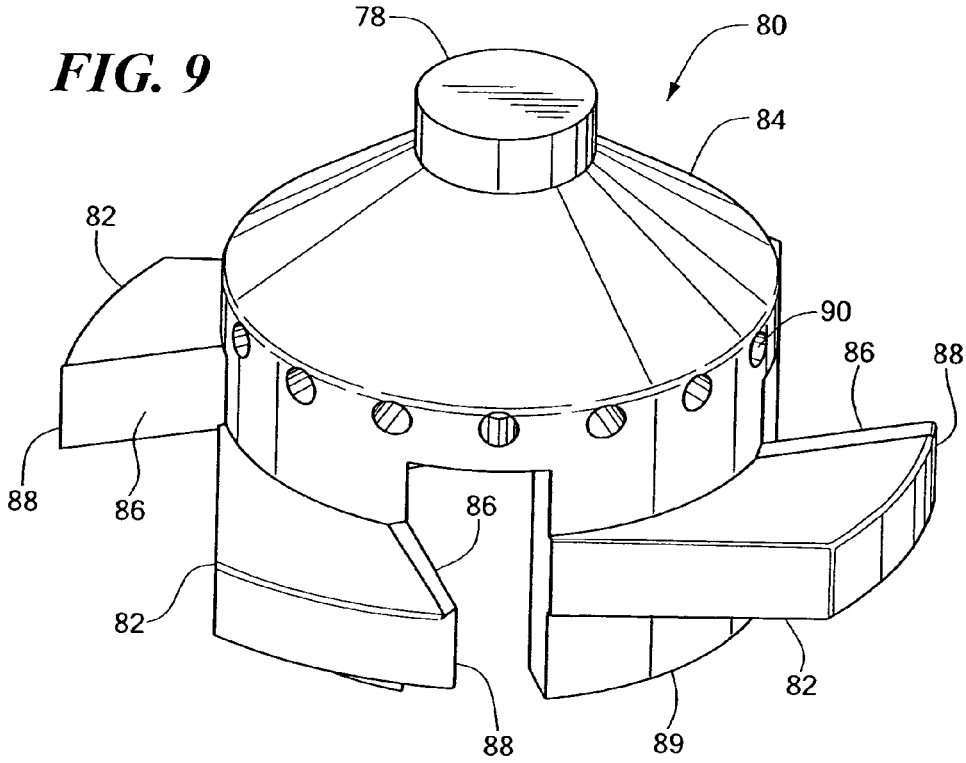
FIG. 9 is a top perspective view of a scraper in the centrifuge of FIG. 8.
Figure 10:
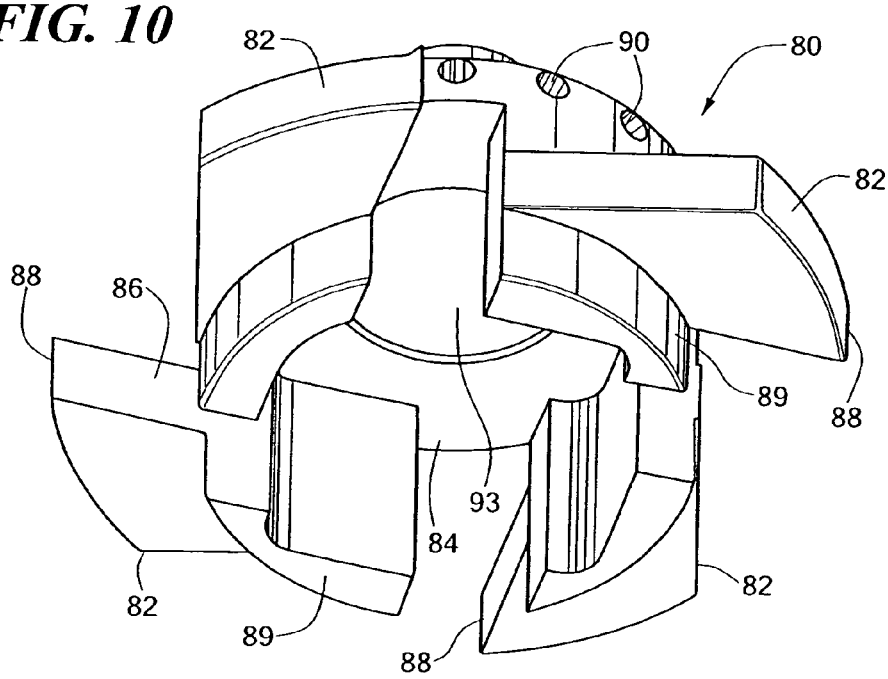
FIG. 10 is a bottom perspective view of the scraper of FIG. 9.
Figure 11:
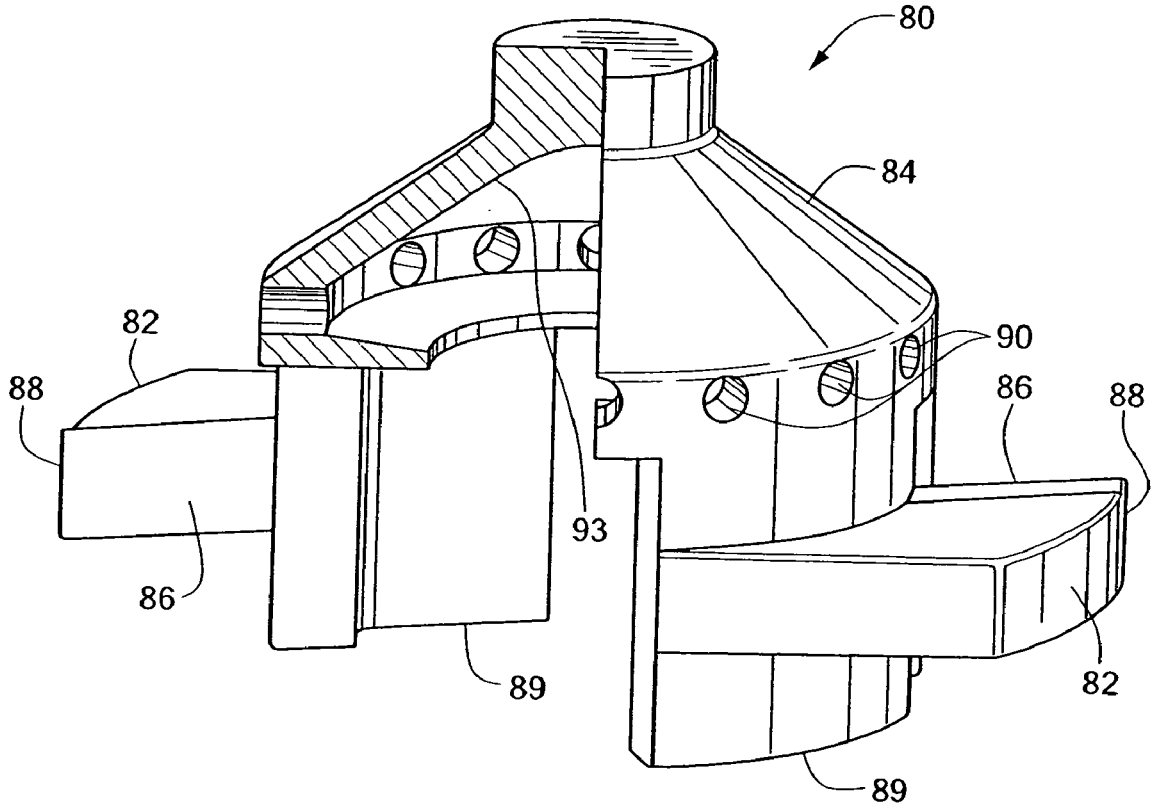
FIG. 11 is side sectional view of the scraper of FIG. 9.

FIGS. 9–11 show different views of the scraper head 80. Four scraper arms 82 extend from a central body portion 84, which includes a number of radially directed feed accelerator holes 90. Alternative embodiments may use fewer or more scraper arms 82. Each scraper arm 82 has a forward surface 86 with an edge portion 88 that is in close contact with the inner surface of the separator bowl 10. The forward surface 86 may be integral with the rest of the arm 82 or may be part of a separate hard material that is attached to the arm 82, such as by welding or brazing. Also shown in FIGS. 9–11 are skirt portions 89 extending downwardly below the arms 82. The function of the skirt portions 89 is described below.

Figure 12:
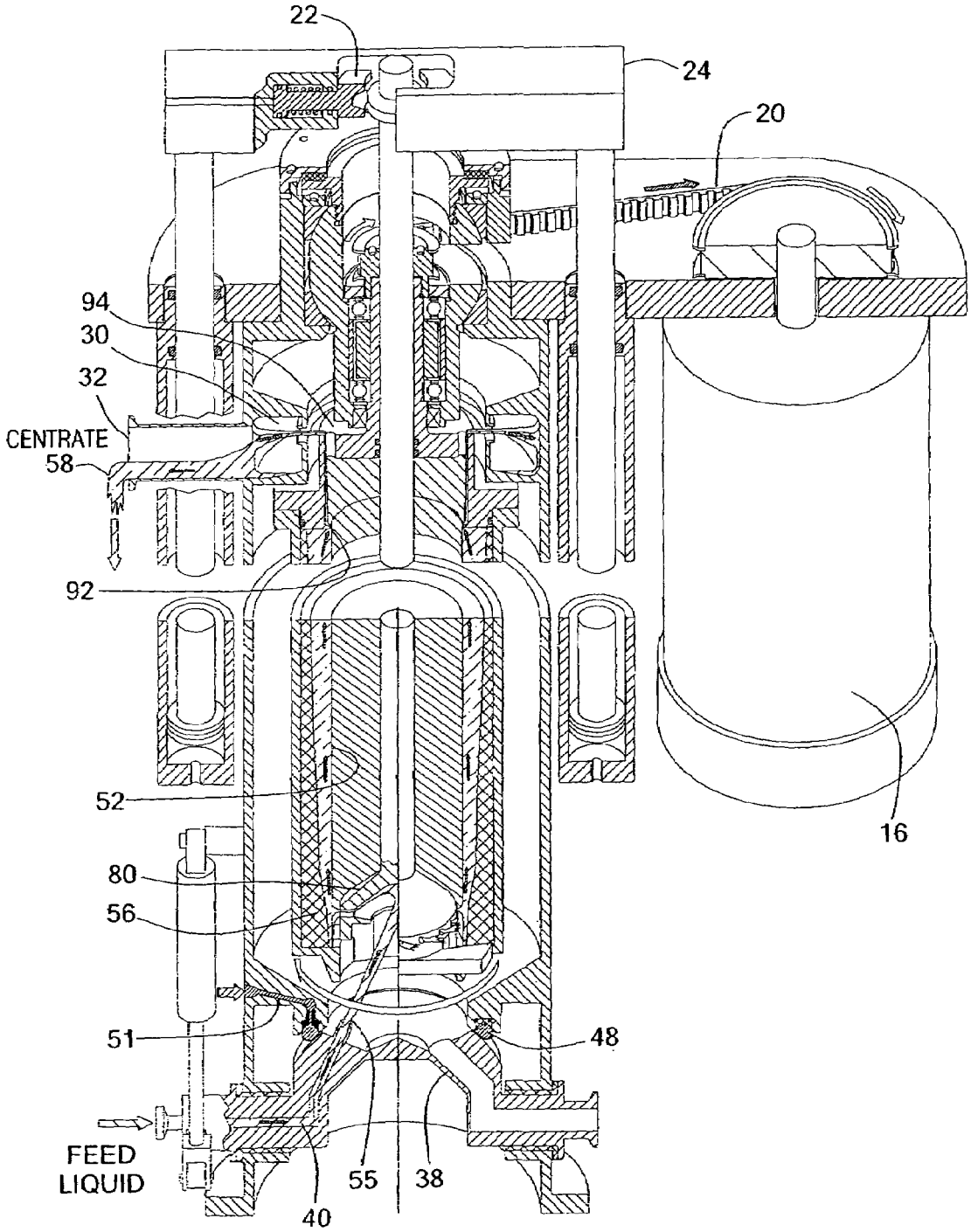
FIG. 12 is a section view of the centrifuge of FIG. 8 illustrating operation in feed mode.
Figure 13:
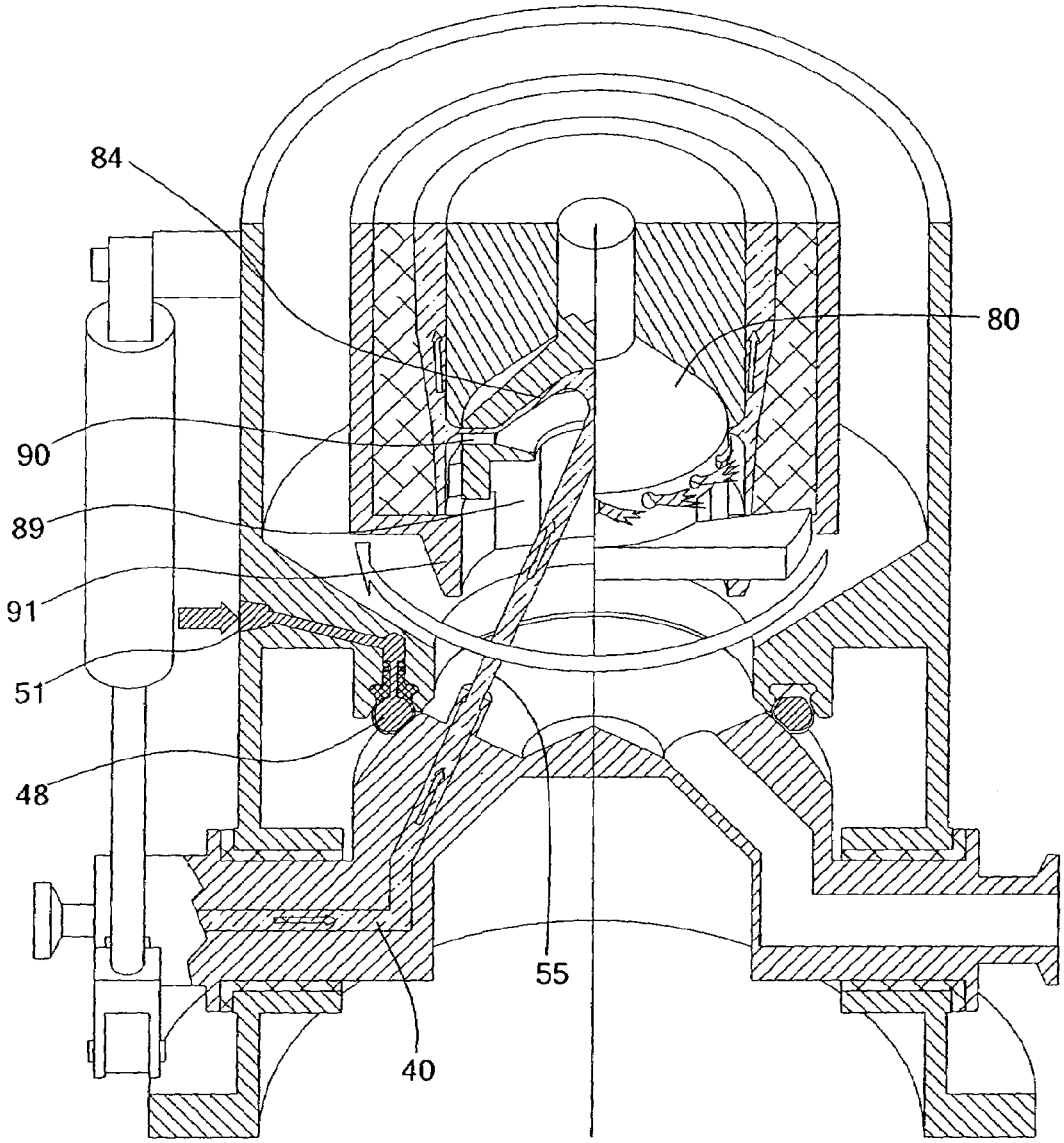
FIG. 13 is a detailed section view of a lower part of the centrifuge of FIG. 12.

FIG. 12 shows the centrifugal separator of FIG. 8 in a feed mode of operation, which is substantially the same as the feed mode of operation of the centrifugal separator of FIGS. 1–7. FIG. 13 shows the area of the scraper head 80 in detail during the feed mode of operation. The scraper head 80 is located at the lower end of the bowl 10, and rotates with the bowl 10 at high speed. The skirt portions 89 of the scraper head 80 extend into a lower opening of the bowl 10, and during the high-speed rotation actually flex slightly outward in response to the centrifugal forces to urge against a lower rim 91 of the bowl 10. By this action, unwanted vibration of the scraper assembly is reduced.

During the feed mode of operation, the feed liquid stream 55 is accelerated radially by action of the scraper head 80 rotating with the separator bowl 10. Specifically, the feed liquid stream 55 hits the underside 93 of the body portion 84 of the scraper head 80 (see FIGS. 10 and 11) and is directed outwardly to the inner surface of the separator bowl 10 through the holes 90. The solids 56 accumulate near the inner surface of the separator bowl 10 as the centrate flows up the inner surface of the separator bowl 10 and eventually out of centrate port outlet 32 as described above with reference to FIG. 3.

Figure 14:
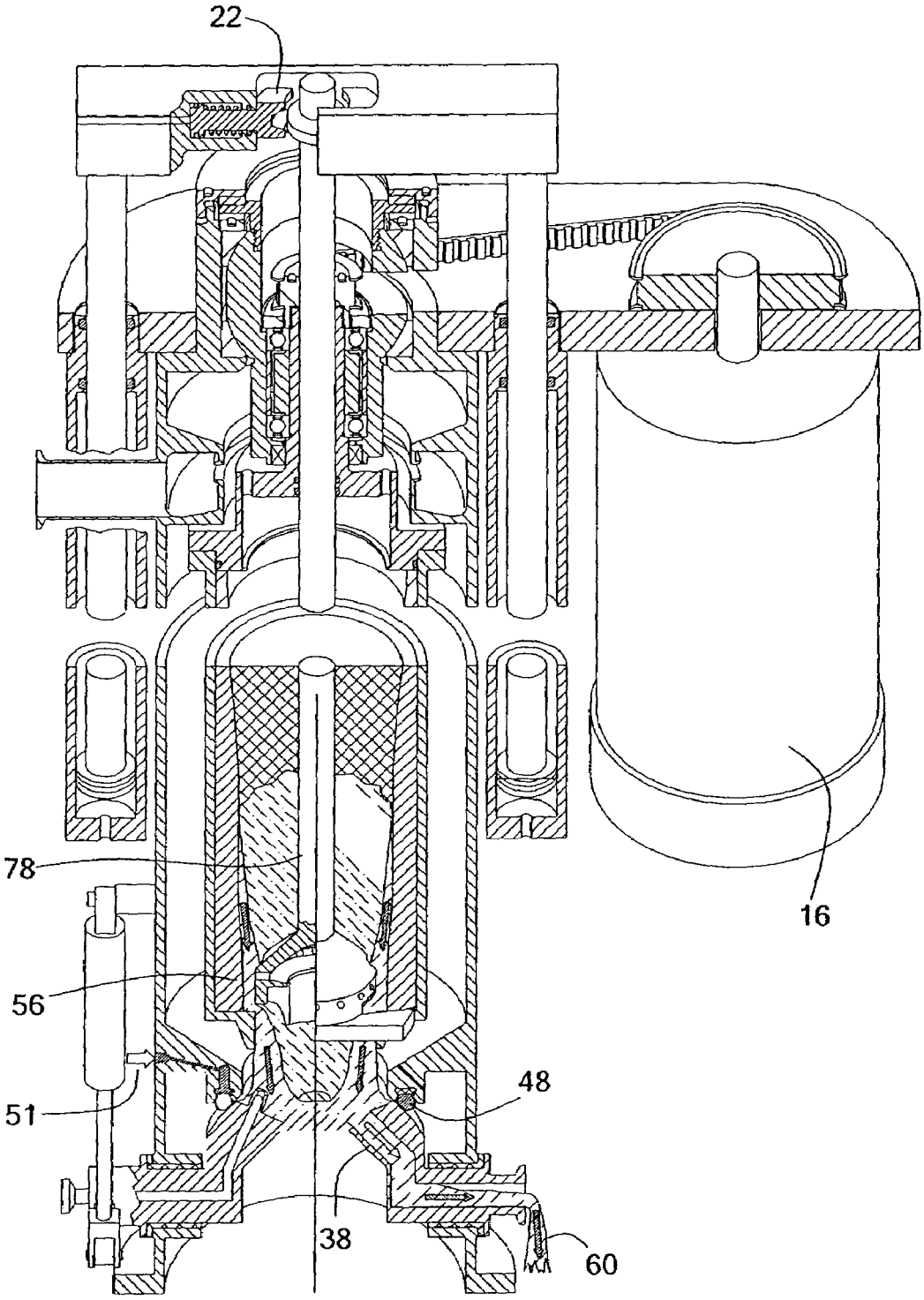
FIG. 14 is a section view of the centrifuge of FIG. 8 illustrating operation in drain mode.

FIG. 14 illustrates the drain mode of operation of the centrifugal separator of FIG. 8. Again, operation is similar to the drain mode of operation of the centrifugal separator of FIGS. 1–7.

Figure 15:
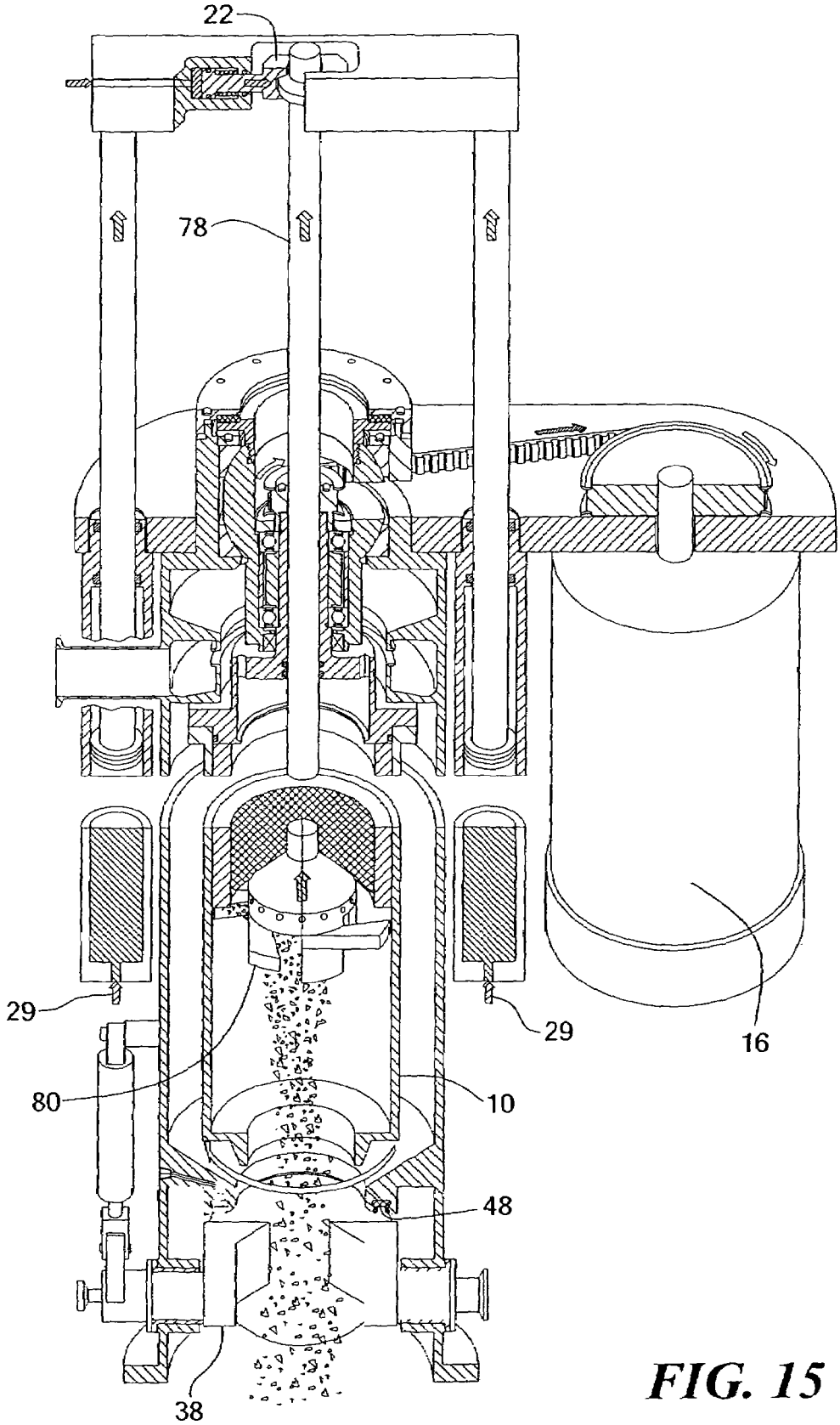
FIG. 15 is a section view of the centrifuge of FIG. 8 illustrating operation in solids discharge mode.

FIG. 15 shows a scrape mode of operation of the centrifugal separator of FIG. 8. The solids valve seal 48 is deflated and the solids valve 38 is rotated away from the bottom of the separator bowl 10, as shown in FIG. 6. The scraper clutch 22 is engaged to prevent the scraper shaft 78 from rotating and to lift the scraper shaft 78 as the scraper actuator is lifted. The motor 16 rotates the bowl at a slow speed as the scraper head 80 is slowly raised. This causes the packed solids to be scraped away along a helical path on the inner surface of the bowl 10. This action continues until the scraper head 80 reaches the top of the bowl 10, at which point it is slowly lowered, scraping away any residual solids as it does so. When this scraping cycle is complete, the solids valve 38 closes again and the solids valve seal 48 is re-inflated, enabling the next feed/drain/scrape cycle to commence.

Optionally, cleaning and/or rinsing fluid may be introduced through the same fluid feed pathway, with operation of the drive motor 16 enabling complete distribution of the cleaning and/or rinsing fluid. A scrape mode of operation, as discussed above, may then be entered to further clean the interior of the separator bowl 10.

Figure 16:
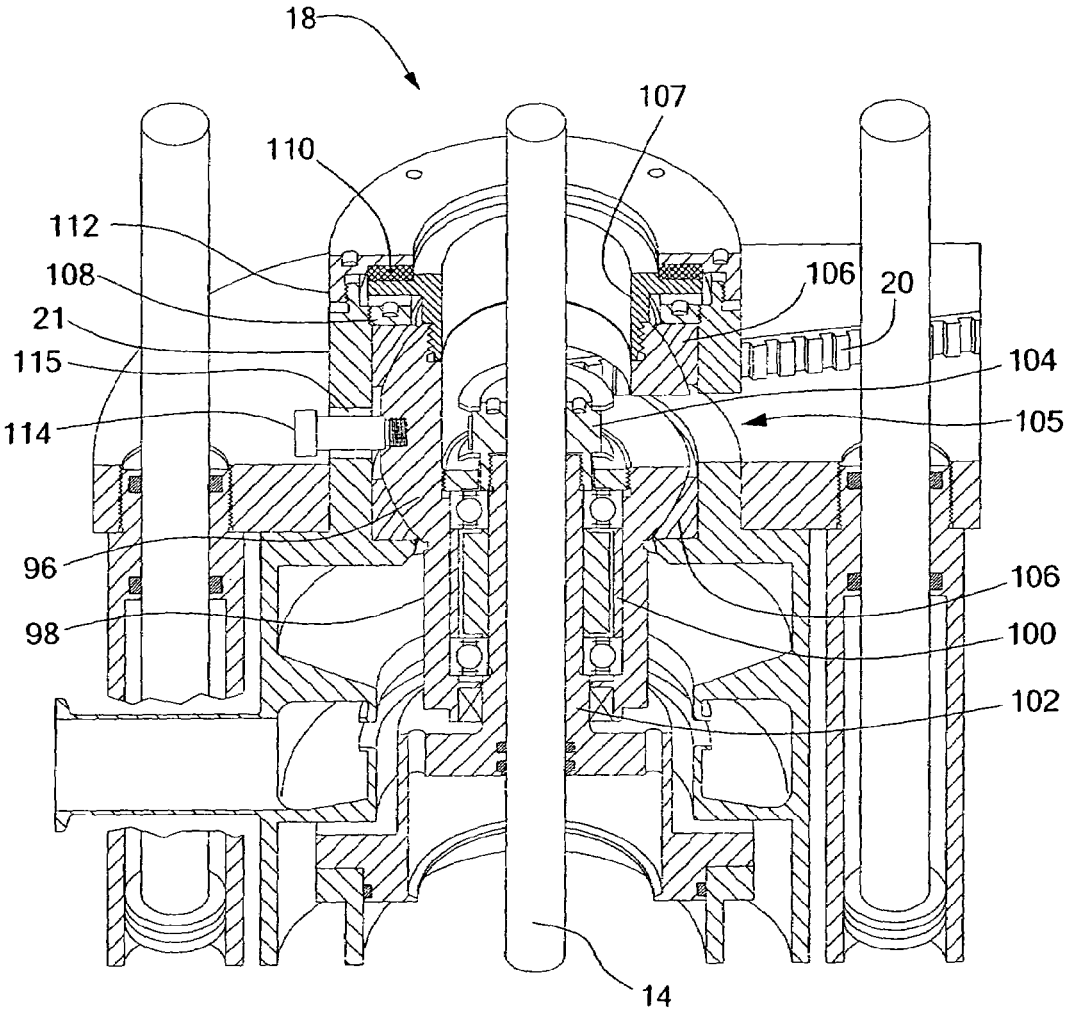
FIG. 16 is a detailed section view of a bowl suspension structure in the centrifuges of FIGS. 1 and 8.

FIG. 16 shows the area of the spindle and bearing assembly of the centrifugal separator of FIGS. 1 and 8. A bearing housing has a semi-spherical portion 96 and a short cylindrical spindle portion 98. In the embodiment shown by FIG. 16, the semi-spherical portion 96 comprises an upper semi-hemispherical portion and a lower semi-hemispherical portion. Mounted within the spindle portion 98 are a bearing 100 and an extended spindle or hub 102 of the separator bowl 10. A driven pulley 104 engaged by the drive belt 20 (which extends through a lateral opening 105 of the spherical portion 96 of the bearing housing) attached to the hub 102. The spherical portion 96 rests against mating surfaces of seats 106. A clearance adjustment nut 108 is used to retain the seats 106 while providing for a desired amount of clearance between the seats 106 and the bearing housing. As seen in FIG. 16, the seats 106 each have an arched surface generally conformed to an outer surface of the semi-spherical portion 96. The arched surfaces of the seats are in substantially compressive contact with and substantially surround or conform to the upper and lower semi-hemispherical portions of the portion 96. The seats 106, therefore, substantially stabilize the portion 96 within the separator housing. A damping rubber support ring is secured to the top of the spherical portion 96. The support ring 107 and a swing-damping rubber ring are retained by a ring compression adjustment nut 112. A bearing housing anti-rotation pin 114 prevents the bearing housing from rotating. The pin extends through an enlarged opening 115 in the housing 13.

The structure depicted in FIG. 16 provides a "simple support" for the rotating spindle 102 and cylindrical separator bowl 10. This simple support permits a limited amount of outward swiveling of the spindle 102 as it rotates about the central vertical axis of the separator at high speed during operation. This helps to reduce vibration associated with the natural frequency of the rotating apparatus, providing for smoother operation and longer life. It will be noted that the anti-rotation pin 114 is fixed with respect to the bearing housing can move within the opening 115 relative to the separator, and therefore does not interfere with this swiveling action.

Figure 17:
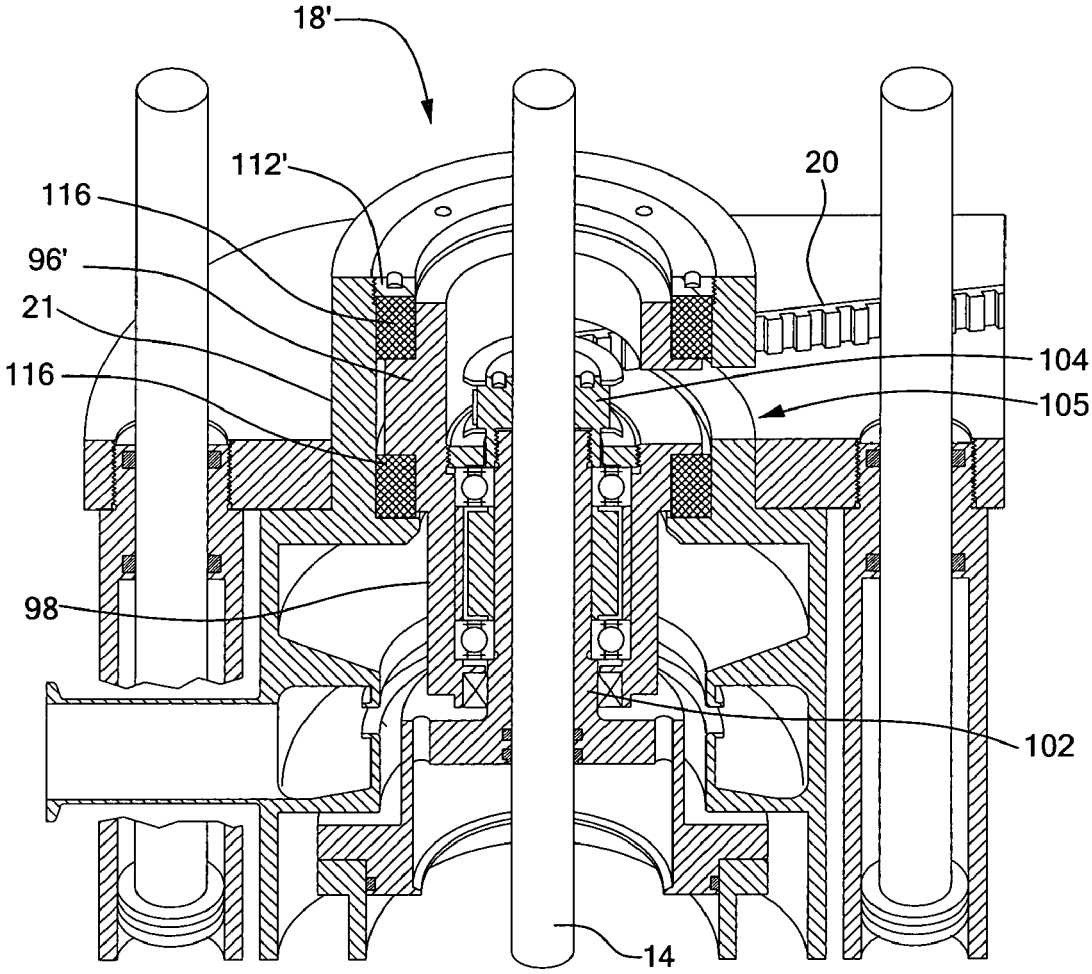
FIG. 17 is a detailed section view of an alternative bowl suspension structure suitable for use in the centrifuges of FIGS. 1 and 8.

FIG. 17 shows an alternative scheme for mounting a bearing and spindle assembly 18'. The bearing housing has a cylindrical upper portion 96' with notches for receiving two rubber isolation rings 116. As seen in FIG. 17, the isolating rings 116 are positioned near the ends of the upper cylindrical portion 96' and disposed within the mounting region of the separator housing. The assembly is held in place by a ring compression adjustment nut 112'. In alternative embodiments, the nut 112 or 112' may be replaced by other structure, including a bolted-on ring or disk.

It will be apparent to those skilled in the art that modifications to and variations of the disclosed methods and apparatus are possible without departing from the inventive concepts disclosed herein, and therefore the invention should not be viewed as limited except to the full scope and spirit of the appended claims.

What is claimed is:

1. A centrifugal separator, comprising:

a separator housing, the separator housing having a main body portion and a mounting region at one end of the main body portion;

a bearing housing, the bearing housing comprising a semi-spherical portion, the semi-spherical portion retained in the mounting region of the separator housing and comprising an upper semi-hemispherical portion and a lower semi-hemispherical portion, a positioning member, the positioning member cooperating with the mounting region to substantially prevent translation of the bearing housing about a rotational axis, and a cylindrical portion, the cylindrical portion extending from the semi-spherical portion and into the main body portion of the separator housing along the rotational axis;

a bearing member disposed within the cylindrical portion of the bearing housing; and a cylindrical centrifugal separator bowl disposed in the main body portion of the separator housing about the rotational axis, the separator bowl comprising a spindle at one end, the spindle being disposed within the bearing housing and being operatively coupleable to a motor for rotation about the rotational axis.

2. A centrifugal separator, comprising:

a separator housing, the separator housing having a main body portion and a mounting region at one end of the main body portion;

a bearing housing, the bearing housing comprising a semi-spherical portion, the semi-spherical portion retained in the mounting region of the separator housing and comprising an upper semi-hemispherical portion and a lower semi-hemispherical portion, a positioning member, the positioning member cooperating with the mounting region to substantially prevent translation of the bearing housing about a rotational axis, and a cylindrical portion, the cylindrical portion extending from the semi-spherical portion and into the main body portion of the separator housing along the rotational axis;

a bearing member disposed within the cylindrical portion of the bearing housing; and a cylindrical centrifugal separator bowl disposed in the main body portion of the separator housing about the rotational axis, the separator bowl comprising a spindle at one end, the spindle being disposed within the bearing housing and being operatively coupleable to a motor for rotation about the rotational axis, wherein the spindle has a central passage lying along the rotational axis through which a shaft member extends into the separator bowl, the shaft member comprising a scraper shaft attached to a scraper head disposed within the separator bowl, wherein the scraper head and scraper shaft are operative to be moved axially along the rotational axis as the separator bowl rotates to scrape accumulated solids from an inside surface of the separator bowl.

3. A centrifugal separator, comprising:

a separator housing, the separator housing having a main body portion and a mounting region at one end of the main body portion;

a bearing housing, the bearing housing comprising a semi-spherical portion, the semi-spherical portion retained in the mounting region of the separator housing and comprising an upper semi-hemispherical portion and a lower semi-hemispherical portion, a positioning member, the positioning member cooperating with the mounting region to substantially prevent translation of the bearing housing about a rotational axis, and a cylindrical portion, the cylindrical portion extending from the semi-spherical portion and into the main body portion of the separator housing along the rotational axis;

a bearing member disposed within the cylindrical portion of the bearing housing; and a cylindrical centrifugal separator bowl disposed in the main body portion of the separator housing about the rotational axis, the separator bowl comprising a spindle at one end, the spindle being disposed within the bearing housing and being operatively coupleable to a motor for rotation about the rotational axis, wherein the spindle has a central passage lying along the rotational axis through which a shaft member extends into the separator bowl, the shaft member comprising a piston shaft attached to a piston head disposed within the separator bowl, wherein the piston head and piston shaft are operative to be moved axially along the rotational axis with the separator bowl rotationally stationary to extrude accumulated solids out of the separator bowl.

4. The centrifugal separator of claim 1, 2 or 3, wherein the mounting region has an opening through which a drive belt member is extendable for coupling the motor to the spindle of the separator bowl.

5. The centrifugal separator of claim 1, 2 or 3, wherein the positioning member is movable with respect to the separator housing and fixed with respect to the bearing housing.

6. The centrifugal separator of claim 1, 2 or 3, further comprising:

a pair of seating elements disposed within the mounting region of the separator housing, the pair of seating elements each having an arched surface conformed to an outer surface of the semi-spherical portion, wherein at least one arched surface is in compressive contact with the upper semi-hemispherical portion of the semi-spherical portion of the bearing housing; and at least another arched surface is in compressive contact with the lower semi-hemispherical portion of the semi-spherical portion of the bearing housing.

7. The centrifugal separator of claim 6, wherein the pair of seating elements are operative to stabilize the bearing housing.

8. The centrifugal separator of claim 6, wherein each arched surface of the pair of seating elements substantially surrounds the respective upper or lower semi-hemispherical portions of the semi-spherical portion.

9. The centrifugal separator of claim 1, wherein the spindle has a central passage lying along the rotational axis through which a shaft member extends into the separator bowl.

10. The centrifugal separator of claim 9, wherein the shaft member comprises:

a scraper shaft attached to a scraper head disposed within the separator bowl, wherein the scraper head and scraper shaft are operative to be moved axially along the rotational axis as the separator bowl rotates to scrape accumulated solids from an inside surface of the separator bowl.

11. The centrifugal separator of claim 9, wherein the shaft member comprises:

a piston shaft attached to a piston head disposed within the separator bowl, wherein the piston head and piston shaft are operative to be moved axially along the rotational axis with the separator bowl rotationally stationary to extrude accumulated solids out of the separator bowl.

12. A centrifugal separator, comprising:

a separator housing, the separator housing having a main body portion and a mounting region at one end of the main body portion;

a bearing housing, the bearing housing comprising an upper cylindrical portion, the upper cylindrical portion retained in the mounting region of the separator housing, a pair of isolation members in compressive contact with the upper cylindrical portion, wherein the pair of isolation members are operative to stabilize the upper cylindrical portion, and a lower cylindrical portion, the lower cylindrical portion extending from the upper cylindrical portion and into the main body portion of the separator housing along a rotational axis;

a bearing member disposed within the lower cylindrical portion of the bearing housing; and a cylindrical centrifugal separator bowl disposed in the main body portion of the separator housing about the rotational axis, the separator bowl comprising a spindle at one end, the spindle being disposed within the bearing housing and being operatively coupleable to a motor for rotation about the rotational axis.

13. The centrifugal separator of claim 12, wherein the mounting region has an opening through which a drive belt member is extendable for coupling the motor to the spindle of the separator bowl.

14. The centrifugal separator of claim 12, wherein the pair of isolation members includes a first and second isolation member;

the first isolation member is positioned near one end of the upper cylindrical portion and disposed within the mounting region of the separator housing; and the second isolation member is positioned near another end of the upper cylindrical portion and disposed within the mounting region of the separator housing.

15. The centrifugal separator of claim 12, wherein the spindle has a central passage lying along the rotational axis through which a shaft member extends into the separator bowl.

16. The centrifugal separator of claim 15, wherein the shaft member comprises:

a scraper shaft attached to a scraper head disposed within the separator bowl, wherein the scraper head and scraper shaft are operative to be moved axially along the rotational axis as the separator bowl rotates to scrape accumulated solids from an inside surface of the separator bowl.

17. The centrifugal separator of claim 15, wherein the shaft member comprises:

a piston shaft attached to a piston head disposed within the separator bowl, wherein the piston head and piston shaft are operative to be moved axially along the rotational axis with the separator bowl rotationally stationary to extrude accumulated solids out of the separator bowl.

18. A centrifugal separator, comprising:

a separator housing, the separator housing having a main body portion and a mounting region at one end of the main body portion;

a bearing housing, the bearing housing comprising a semi-spherical portion, the semi-spherical portion retained in the mounting region of the separator housing and comprising an upper semi-hemispherical portion and a lower semi-hemispherical portion, a first arched seating element, wherein the first arched seating element is in compressive contact with and substantially conforms to the upper semi-hemispherical portion of the semi-spherical portion, a second arched seating element, wherein the second arched seating element is in compressive contact with and substantially conforms to the lower semi-hemispherical portion of the semi-spherical portion, and a cylindrical portion, the cylindrical portion extending from the semi-spherical portion and into the main body portion of the separator housing along a rotational axis;

a bearing member disposed within the cylindrical portion of the bearing housing; and a cylindrical centrifugal separator bowl disposed in the main body portion of the separator housing about the rotational axis, the separator bowl comprising a spindle at one end, the spindle being disposed within the bearing housing and being operatively coupleable to a motor for rotation about the rotational axis.

19. A centrifugal separator, comprising:

a separator housing, the separator housing having a main body portion and a mounting region at one end of the main body portion;

a bearing housing, the bearing housing comprising a semi-spherical portion, the semi-spherical portion retained in the mounting region of the separator housing and comprising an upper semi-hemispherical portion and a lower semi-hemispherical portion, a first arched seating element, wherein the first arched seating element is in compressive contact with and substantially conforms to the upper semi-hemispherical portion of the semi-spherical portion, a second arched seating element, wherein the second arched seating element is in compressive contact with and substantially conforms to the lower semi-hemispherical portion of the semi-spherical portion, and a cylindrical portion, the cylindrical portion extending from the semi-spherical portion and into the main body portion of the separator housing along a rotational axis;

a bearing member disposed within the cylindrical portion of the bearing housing; and a cylindrical centrifugal separator bowl disposed in the main body portion of the separator housing about the rotational axis, the separator bowl comprising a spindle at one end, the spindle being disposed within the bearing housing and being operatively coupleable to a motor for rotation about the rotational axis, wherein the spindle has a central passage lying along the rotational axis through which a shaft member extends into the separator bowl, the shaft member comprising a scraper shaft attached to a scraper head disposed within the separator bowl, wherein the scraper head and scraper shaft are operative to be moved axially along the rotational axis as the separator bowl rotates to scrape accumulated solids from an inside surface of the separator bowl.

20. A centrifugal separator, comprising:

a separator housing, the separator housing having a main body portion and a mounting region at one end of the main body portion;

a bearing housing, the bearing housing comprising a semi-spherical portion, the semi-spherical portion retained in the mounting region of the separator housing and comprising an upper semi-hemispherical portion and a lower semi-hemispherical portion, a first arched seating element, wherein the first arched seating element is in compressive contact with and substantially conforms to the upper semi-hemispherical portion of the semi-spherical portion, a second arched seating element, wherein the second arched seating element is in compressive contact with and substantially conforms to the lower semi-hemispherical portion of the semi-spherical portion, and a cylindrical portion, the cylindrical portion extending from the semi-spherical portion and into the main body portion of the separator housing along a rotational axis;

a bearing member disposed within the cylindrical portion of the bearing housing; and a cylindrical centrifugal separator bowl disposed in the main body portion of the separator housing about the rotational axis, the separator bowl comprising a spindle at one end, the spindle being disposed within the bearing housing and being operatively coupleable to a motor for rotation about the rotational axis, wherein the spindle has a central passage lying along the rotational axis through which a shaft member extends into the separator bowl, the shaft member comprising a piston shaft attached to a piston head disposed within the separator bowl, wherein the piston head and piston shaft are operative to be moved axially along the rotational axis with the separator bowl rotationally stationary to extrude accumulated solids out of the separator bowl.

21. The centrifugal separator of claim 18, 19 or 20, wherein the mounting region has an opening through which a drive belt member is extendable for coupling the motor to the spindle of the separator bowl.

22. The centrifugal separator of claim 18, 19 or 20, wherein the first and second arched seating elements operatively stabilize of the bearing housing.

23. The centrifugal separator of claim 18, wherein the spindle has a central passage lying along the rotational axis through which a shaft member extends into the separator bowl.

24. The centrifugal separator of claim 23, wherein the shaft member comprises:

a scraper shaft attached to a scraper head disposed within the separator bowl, wherein the scraper head and scraper shaft are operative to be moved axially along the rotational axis as the separator bowl rotates to scrape accumulated solids from an inside surface of the separator bowl.

25. The centrifugal separator of claim 23, wherein the shaft member comprises:

a piston shaft attached to a piston head disposed within the separator bowl, wherein the piston head and piston shaft are operative to be moved axially along the rotational axis with the separator bowl rotationally stationary to extrude accumulated solids out of the separator bowl.

26. A centrifugal separator, comprising:

a separator housing, the separator housing having a main body portion and a mounting region at one end of the main body portion;

a bearing housing, the bearing housing comprising a semi-spherical portion, the semi-spherical portion retained in the mounting region of the separator housing and comprising an upper semi-hemispherical portion and a lower semi-hemispherical portion, a positioning member, the positioning member cooperating with the mounting region to substantially prevent translation of the bearing housing about a rotational axis, a first arched seating element, wherein the first arched seating element is in compressive contact with and substantially conforms to the upper semi-hemispherical portion of the semi-spherical portion, a second arched seating element, wherein the second arched seating element is in compressive contact with and substantially conforms to the lower semi-hemispherical portion of the semi-spherical portion, and a cylindrical portion, the cylindrical portion extending from the semi-spherical portion and into the main body portion of the separator housing along the rotational axis;

a bearing member disposed within the cylindrical portion of the bearing housing; and a cylindrical centrifugal separator bowl disposed in the main body portion of the separator housing about the rotational axis, the separator bowl comprising a spindle at one end, the spindle being disposed within the bearing housing and being operatively coupleable to a motor for rotation about the rotational axis.

27. A centrifugal separator, comprising:

a separator housing, the separator housing having a main body portion and a mounting region at one end of the main body portion;

a bearing housing, the bearing housing comprising a semi-spherical portion, the semi-spherical portion retained in the mounting region of the separator housing and comprising an upper semi-hemispherical portion and a lower semi-hemispherical portion, a positioning member, the positioning member cooperating with the mounting region to substantially prevent translation of the bearing housing about a rotational axis, a first arched seating element, wherein the first arched seating element is in compressive contact with and substantially conforms to the upper semi-hemispherical portion of the semi-spherical portion, a second arched seating element, wherein the second arched seating element is in compressive contact with and substantially conforms to the lower semi-hemispherical portion of the semi-spherical portion, and a cylindrical portion, the cylindrical portion extending from the semi-spherical portion and into the main body portion of the separator housing along the rotational axis;

a bearing member disposed within the cylindrical portion of the bearing housing; and a cylindrical centrifugal separator bowl disposed in the main body portion of the separator housing about the rotational axis, the separator bowl comprising a spindle at one end, the spindle being disposed within the bearing housing and being operatively coupleable to a motor for rotation about the rotational axis, wherein the spindle has a central passage lying along the rotational axis through which a shaft member extends into the separator bowl, the shaft member comprising a scraper shaft attached to a scraper head disposed within the separator bowl, wherein the scraper head and scraper shaft are operative to be moved axially along the rotational axis as the separator bowl rotates to scrape accumulated solids from an inside surface of the separator bowl.

28. A centrifugal separator, comprising:

a separator housing, the separator housing having a main body portion and a mounting region at one end of the main body portion;

a bearing housing, the bearing housing comprising a semi-spherical portion, the semi-spherical portion retained in the mounting region of the separator housing and comprising an upper semi-hemispherical portion and a lower semi-hemispherical portion, a positioning member, the positioning member cooperating with the mounting region to substantially prevent translation of the bearing housing about a rotational axis, a first arched seating element, wherein the first arched seating element is in compressive contact with and substantially conforms to the upper semi-hemispherical portion of the semi-spherical portion, a second arched seating element, wherein the second arched seating element is in compressive contact with and substantially conforms to the lower semi-hemispherical of the semi-spherical portion, and a cylindrical portion, the cylindrical portion extending from the semi-spherical portion and into the main body portion of the separator housing along the rotational axis;

a bearing member disposed within the cylindrical portion of the bearing housing; and a cylindrical centrifugal separator bowl disposed in the main body portion of the separator housing about the rotational axis, the separator bowl comprising a spindle at one end, the spindle being disposed within the bearing housing and being operatively coupleable to a motor for rotation about the rotational axis, wherein the spindle has a central passage lying along the rotational axis through which a shaft member extends into the separator bowl, the shaft member comprising a piston shaft attached to a piston head disposed within the separator bowl, wherein the piston head and piston shaft are operative to be moved axially along the rotational axis with the separator bowl rotationally stationary to extrude accumulated solids out of the separator bowl.

29. The centrifugal separator of claim 26, 27 or 28, wherein the mounting region has an opening through which a drive belt member is extendable for coupling the motor to the spindle of the separator bowl.

30. The centrifugal separator of claim 26, 27 or 28, wherein the first and second arched seating elements operatively stabilize the bearing housing.

31. The centrifugal separator of claim 26, 27 or 28, wherein the positioning member is movable with respect to the separator housing and fixed with respect to the bearing housing portion.

32. The centrifugal separator of claim 26, wherein the spindle has a central passage lying along the rotational axis through which a shaft member extends into the separator bowl.

33. The centrifugal separator of claim 32, wherein the shaft member comprises:

a scraper shaft attached to a scraper head disposed within the separator bowl, wherein the scraper head and scraper shaft are operative to be moved axially along the rotational axis as the separator bowl rotates to scrape accumulated solids from an inside surface of the separator bowl.

34. The centrifugal separator of claim 32, wherein the shaft member comprises:

a piston shaft attached to a piston head disposed within the separator bowl, wherein the piston head and piston shaft are operative to be moved axially along the rotational axis with the separator bowl rotationally stationary to extrude accumulated solids out of the separator bowl.

35. A bearing housing for a centrifugal separator, comprising:

a semi-spherical portion, the semi-spherical portion comprising an upper semi-hemispherical portion and a lower semi-hemispherical portion;

a positioning member, the positioning member cooperating with a mounting region of the centrifugal separator to substantially prevent translation of the bearing housing about a rotational axis;

a first arched seating element in compressive contact with and substantially conforming to upper semi-hemispherical portion of the semi-spherical portion;

a second arched seating element in compressive contact with and substantially conforming to the lower semi-hemispherical portion of the semi-spherical portion;

a cylindrical portion extending from the semi-spherical portion along the rotational axis; and a bearing member disposed within the cylindrical portion of the bearing housing and adapted to receive a spindle of a separator bowl.

36. The bearing housing for the centrifugal separator of claim 35, wherein the semi-spherical portion has an opening through which a drive belt member is extendable for coupling a motor to the spindle of the separator bowl.

37. The bearing housing for the centrifugal separator of claim 35, wherein the first and second arched seating elements operatively stabilize the bearing housing.

38. The bearing housing for the centrifugal separator of claim 35, wherein the positioning member is movable with respect to a separator housing of the centrifugal separator and fixed with respect to the bearing housing.

* * * * *

UNITED STATES PATENT AND TRADEMARK OFFICE

CERTIFICATE OF CORRECTION

PATENT NO. : 6,986,734 B2
APPLICATION NO. : 10/874150
DATED : January 17, 2006
INVENTOR(S) : Robert B. Carr It is certified that error appears in the above-identified patent and that said Letters Patent is hereby corrected as shown below:

Column 7, line 28, “housing can move” should read --housing but can move--; and

Column 7, line 29, “separator, and” should read --separator housing, and--.

Signed and Sealed this

Thirteenth Day of March, 2007

JON W. DUDAS
*Director of the United States Patent and Trademark Office*